US011324296B2

(12) United States Patent
Streng et al.

(10) Patent No.: US 11,324,296 B2
(45) Date of Patent: May 10, 2022

(54) REINFORCING MEMBER FOR A BAG

(71) Applicant: BIG TIME PRODUCTS, LLC, Rome, GA (US)

(72) Inventors: Jarrod Thomas Streng, Atlanta, GA (US); Christopher Matthew Weed, Marietta, GA (US); Mark Lee Butts, Atlanta, GA (US); Ryan Lee-Nowland Kubica, Marietta, GA (US); James Blake Fievet, Decatur, GA (US); Jing Li, Shanghai (CN)

(73) Assignee: BIG TIME PRODUCTS, LLC, Rome, GA (US)

( * ) Notice: Subject to any disclaimer, the term of this patent is extended or adjusted under 35 U.S.C. 154(b) by 355 days.

(21) Appl. No.: 16/530,014

(22) Filed: Aug. 2, 2019

(65) Prior Publication Data

US 2020/0037722 A1 Feb. 6, 2020

Related U.S. Application Data

(60) Provisional application No. 62/714,453, filed on Aug. 3, 2018.

(51) Int. Cl.
*A45C 13/36* (2006.01)

(52) U.S. Cl.
CPC ..... *A45C 13/36* (2013.01)

(58) Field of Classification Search
CPC ..... A45C 13/36; A45C 2003/007; A45C 3/00
USPC ..... 150/128; 190/37, 126, 127; 383/107; 112/418, 419
See application file for complete search history.

(56) References Cited

U.S. PATENT DOCUMENTS

| | | | | |
|---|---|---|---|---|
| D38,567 | S | 5/1907 | Sackman | |
| 2,138,610 | A * | 11/1938 | Overly | A47G 25/54 112/417 |
| 2,440,138 | A | 4/1948 | Benenfeld | |
| 2,487,951 | A | 11/1949 | Stein | |
| 2,651,049 | A * | 9/1953 | Burkhard | A41D 27/24 112/419 |
| D184,098 | S | 12/1958 | McCord | |
| D184,101 | S | 12/1958 | McCord | |
| D185,023 | S | 4/1959 | McCord | |
| D185,026 | S | 4/1959 | McCord | |
| D185,027 | S | 4/1959 | McCord | |
| 3,203,517 | A * | 8/1965 | Stein | D05B 93/00 190/126 |

(Continued)

FOREIGN PATENT DOCUMENTS

JP 2001025589 1/2001

OTHER PUBLICATIONS

Statement.

*Primary Examiner* — Sue A Weaver
(74) *Attorney, Agent, or Firm* — Thompson Hine LLP

(57) ABSTRACT

A bag including a first panel having an outer edge and a second panel having an outer edge. The second panel is coupled to the first panel by a first coupling mechanism that is spaced away from the outer edges. The bag further includes a reinforcing member extending along and at least partially covering at least one of the outer edge of the first panel, the outer edge of the second panel, or the first coupling mechanism. The reinforcing member is coupled to at least one of the first panel, the second panel or the first coupling mechanism by a second coupling mechanism.

19 Claims, 2 Drawing Sheets

(56) References Cited

U.S. PATENT DOCUMENTS

| | | | | | |
|---|---|---|---|---|---|
| 4,093,773 | A | * | 6/1978 | Danko | B29C 48/34 428/365 |
| 4,163,484 | A | * | 8/1979 | Delaney | A45C 13/42 190/115 |
| D314,673 | S | | 2/1991 | Legare | |
| 5,014,636 | A | | 5/1991 | Seber | |
| D370,127 | S | | 5/1996 | Bonaddio et al. | |
| D382,118 | S | | 8/1997 | Ferrero | |
| D436,738 | S | | 1/2001 | Bredendick et al. | |
| D630,860 | S | | 1/2011 | Sichel | |
| D672,181 | S | | 12/2012 | Stoddard | |
| D736,543 | S | | 8/2015 | Bramm | |
| 9,247,794 | B2 | | 2/2016 | Cross et al. | |
| 2003/0150681 | A1 | | 8/2003 | Chen | |
| 2012/0255971 | A1 | | 10/2012 | Griffith | |
| 2016/0194133 | A1 | | 7/2016 | Henry | |

* cited by examiner

REINFORCING MEMBER FOR A BAG

This application claims priority to U.S. Provisional Patent Application Ser. No. 62/714,453, filed on Aug. 3, 2018 and entitled REINFORCING EDGE MEMBER FOR A BAG SEAM, the entire contents of which are hereby incorporated by reference.

The present disclosure is directed to a reinforcing member, and more particularly, to a reinforcing member for use with a bag.

BACKGROUND

Bags, totes, duffels and other storage devices (collectively termed "bags" herein) are often used to carry and store a variety of tools, articles and other loose items. Such bags are often made of various panels joined together along their outer edges, such as by stitching. However, bags formed with conventional stitching can be prone to tearing or other failure.

SUMMARY

The present disclosure relates to a bag including panels joined together along a seam, wherein the reinforcing member covers at least part of the seam. More particularly, in one embodiment the invention is a bag including a first panel having an outer edge and a second panel having an outer edge. The second panel is coupled to the first panel by a first coupling mechanism that is spaced away from the outer edges. The bag further includes a reinforcing member extending along and at least partially covering at least one of the outer edge of the first panel, the outer edge of the second panel, or the first coupling mechanism. The reinforcing member is coupled to at least one of the first panel, the second panel or the first coupling mechanism by a second coupling mechanism.

DETAILED DESCRIPTION

Figure 1:
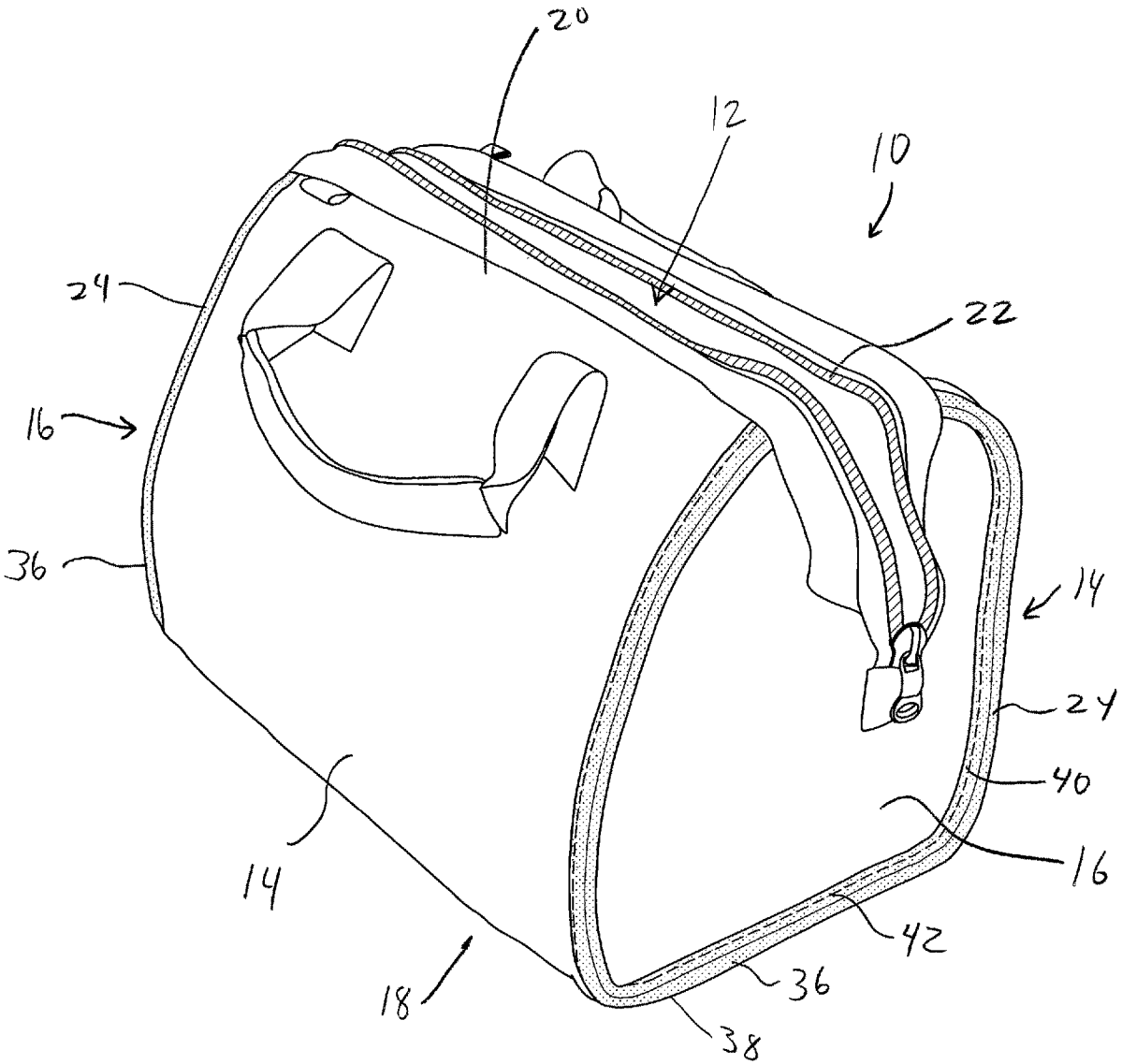
FIG. 1 is a front perspective view of one embodiment of a bag.

FIG. 1 illustrates a bag 10 defining an inner cavity 12 configured to store loose items therein. The bag 10 includes a pair of opposed side walls 14, a pair of opposed end walls 16, a bottom 18 and a top structure 20 which includes two portions thereof which are releasably attachable by a zipper 22 or other releasable fastening mechanism. The bag 10 can thus be generally formed as a rectangular prism. However it should be understood that the bag 12 can take various other forms and configurations other than that specifically shown in the drawings. The bag 12 may not necessarily be closable and can, for example, lack the top structure 22 can have an open top, such that the bag 12 takes the form of an open tote structure. The bag 10 can include or be made of various panels which are joined together. For example, in one embodiment the side walls 14, bottom 18 and top structure 20 are formed by a continuous panel or discrete panels attached together, which are, in turn, coupled to the end walls 16 about seams 24 extending about a periphery of each end wall 16.

Figure 2:
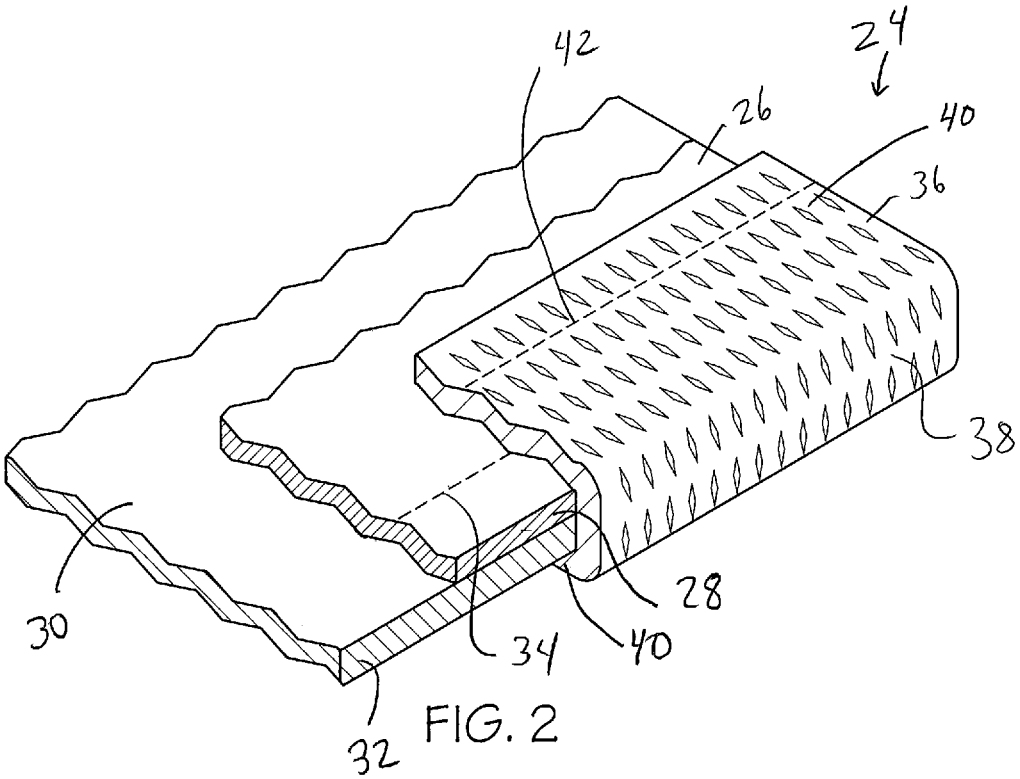
FIG. 2 is a detail view of part of a seam of the bag of FIG. 1, with portions cut away.
Figure 3:
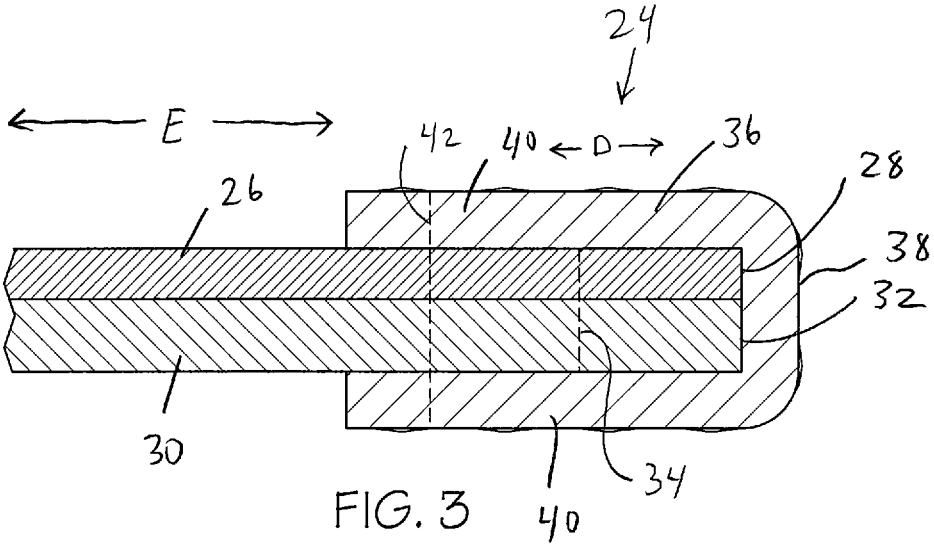
FIG. 3 is a side cross-section of the seam of FIG. 2.

As shown in FIGS. 2 and 3 each seam 24 can include a first panel 26 (e.g. in one case a panel for the end wall 16) having an outer edge 28, and a second panel 30 (e.g. in one case a panel for the side walls 14 and/or bottom 18 and/or top structure 20) having an outer edge 32. The first panel 26 and second panel 30 can be coupled together by a first coupling mechanism 34. In the illustrated embodiment the first coupling mechanism 34 is a sewn stitching line formed for example by stitching/stitches extending through the first 26 and second 30 panels. However the first coupling mechanism 34 can take any of a wide variety of other forms, such as adhesives, welding, soldering, fastening devices, mating threads, compression fittings, slotted fittings, rivets and the like. In the illustrated embodiment, the outer edges 28, 32 of the first 26 and second 30 panels are generally aligned, and the first coupling mechanism 34 is oriented generally parallel to the outer edges 28, 32. In addition the first coupling mechanism 34 can be entirely spaced away from the outer edges 28, 32 along a direction D oriented perpendicular to the outer edges 28, 32.

The seam 24 can further include a reinforcing member 36 which is generally "U" shaped in end view, having a base 38 and a pair of legs 40 oriented perpendicular to the base 38. The reinforcing member 36 is wrapped around the outer edges 28, 32 of the first 26 and second 30 panels, receiving the first 26 and second 30 panels between the legs 40. The legs 40 can be generally parallel and their distal tips can be aligned such that the "U" shape is generally symmetrical. In one embodiment the first 26 and second panels 30 are the only panels positioned within the reinforcing member 36, and the bag 10/seam 24 lacks or excludes any other panels positioned within the reinforcing member 36. In addition, the reinforcing member 36/legs 40 can be single ply, e.g. the reinforcing member 36 may lack any folds or other plies or portions folded over or under itself, and, the seam 24 may have no more than four plies across its thickness (e.g. the two legs 40, first panel 26 and the second panel 30).

In one embodiment the first 26 and second 30 panels extend away from the seam 24 in a generally flat and planar manner. More particularly, in one case the first 26 and second 30 panels are generally flat and planar, in a direction perpendicular to the outer edges 28, 32 and at locations extending away from but immediately adjacent to the seam 24/reinforcing member 36 (e.g. at location E), for a distance of at least about 1 inch, or a distance of at least about 5 inches, or a distance at least equal to the width of the reinforcing member 36 (in a direction perpendicular to the outer edges 28, 32).

The reinforcing member 36 can be attached to the first panel 26 and/or second panel 30 and/or the first coupling mechanism 34 by a second coupling mechanism 42, which takes the form of a sewn stitching line in the illustrated embodiment, but can also take the form of the other coupling mechanisms that are described above in the context of the first coupling mechanism 34. In the illustrated embodiment where the second coupling mechanism 42 takes the form of stitching, the stitching can extend entirely through both legs 40 of the reinforcing member 36, and entirely through the first 26 and second 30 panels. The second coupling mechanism 42 can be oriented generally parallel to the outer edges 28, 32 and/or the first coupling mechanism 34.

The reinforcing member 36 can thus extend along and at least partially cover at least one of the outer edge 28 of the first panel 26, the outer edge 32 of the second panel 30 or the first coupling mechanism 34. The second coupling mechanism 42 can be spaced farther away from the outer edges 28, 32 than the first coupling mechanism 34 is spaced away from the outer edges 28, 32 along direction D.

In addition, the first 34 and/or second coupling mechanism 42 can be entirely spaced away from the outer edges 28, 32 and/or the other coupling mechanism 34, 42 and can, for example, lack or exclude any loop, overhand or spiral stitching or any coupling mechanism that is at least partially positioned outside the outer edges 28, 32. Positioning the first 34 and/or second 42 coupling mechanisms such that they are entirely spaced away from the outer edges 28, 32 can provide certain advantages. In particular, if the first coupling mechanism 34 were to extend over the outer edge 28 and/or outer edge 32, that portion of the first coupling mechanism 34 could be prone to abrasion or tearing due to greater forces applied to the edges 28, 32 during use of the bag 10. In contrast, by spacing the first 34 and/or second 42 coupling mechanisms from the edges 28, 32, such abrasion and tearing forces can be reduced.

In addition, the use of the second coupling mechanism 42, separate and apart from the first coupling mechanism 34, to secure the reinforcing member 36 provides additional protection to the first coupling mechanism 34, since the first coupling mechanism 34 is positioned under, and protected by, the reinforcing member 36. Moreover, the use of a separate coupling mechanism 42 for the reinforcing member 36 ensures that if the second coupling mechanism 42 were to fail, the first 26 and second 30 panels would nevertheless remain coupled together by the first coupling mechanism 34 and the seam 24 would retain its structural integrity.

Although not shown, the first coupling mechanism 34 can also be coupled to the first coupling mechanism 42 if desired. In the case where both the first coupling mechanism 34 and second coupling mechanism 42 are, for example, stitching, it is possible for the first coupling mechanism 34 to be coupled to the second coupling mechanism 42 when the first coupling mechanism 34 is aligned with or positioned sufficiently close to the second coupling mechanism 42. In addition, when the first coupling mechanism 34 is for example an adhesive, the adhesive can be positioned below the second coupling mechanism 42 such that when the second coupling mechanism 42 is the form of stitching it can extend through and thereby be coupled to the adhesive.

The reinforcing member 36 can be made of any of a wide variety of materials, such as a non-woven material including but not limited to thermoplastic rubber or comparable material, polyvinyl chloride, plastics, polymers or composite materials. The reinforcing member 36 thus can be made of a relatively rugged material which resists abrasion and tearing, and thereby provides protection to the outer edges 28, 32 and the first coupling mechanism 34.

The reinforcing member 36 can have a textured pattern on its outer surface to reduce glare and improve friction such that the bag 10 can be retained in place and resist sliding when placed on slick or angled surfaces. In the illustrated embodiment, the textured pattern takes the form of a series of embossed or debossed quadrilaterals, such as diamonds, arranged in an array, although the textured pattern can take any of a wide variety of other shapes and configurations.

In one case the reinforcing member 36 can be positioned on an outside surface of the bag 10, e.g. positioned outside an inner cavity 12 of the bag 10. As shown in FIG. 1, in one embodiment, the bag 10 can include two separate seams 24 and two separate pieces of reinforcing member 36, each extending around the periphery of an associated end wall 16, wherein each reinforcing member 36 is a single continuous piece that extends about corners of the associated panels, and extend around at least three outer edges of the rectangular prism of the bag 10. The reinforcing member 36 can thus extend generally the entire length of the outer edges 28, 32.

The present invention has been described herein with regard to certain embodiments. However, it will be obvious to persons skilled in the art that a number of variations and modifications can be made without departing from the scope of the invention as described herein.

What is claimed is:

1. A bag comprising:

a first panel having an outer edge;

a second panel having an outer edge and coupled to the first panel by a first coupling mechanism that is spaced away from the outer edges; and a reinforcing member extending along and at least partially covering at least one of the outer edge of the first panel, the outer edge of the second panel, or the first coupling mechanism, wherein the reinforcing member is coupled to at least one of the first panel, the second panel or the first coupling mechanism by a second coupling mechanism, wherein the first coupling mechanism is stitching that extends through the first and second panels but through not the reinforcing member, and wherein the second coupling member is stitching that extends through the first and second panels and the reinforcing member.

2. The bag of claim 1 wherein the first coupling mechanism and second coupling mechanisms are each oriented parallel to the outer edges of the first and second panels.

3. The bag of claim 2 wherein the first coupling mechanism is positioned closer to the outer edges of the first and second panels than the second coupling mechanism.

4. The bag of claim 1 wherein the reinforcing member is generally "U" shaped in end view and is wrapped around the outer edge of the first panel, the outer edge of the second panel and the first coupling mechanism.

5. The bag of claim 4 wherein the bag lacks any other panels positioned within the reinforcing member other than the first and second panels.

6. The bag of claim 1 wherein the outer edges of the first and second panels each have a corner and wherein the reinforcing member is wrapped around the corner.

7. The bag of claim 1 wherein the bag is shaped generally as a rectangular prism, and wherein the reinforcing member is a single continuous piece of material extending around at least three outer edges thereof.

8. The bag of claim 1 wherein an entirety of the first coupling mechanism is spaced away from the outer edges in a direction perpendicular thereto.

9. The bag of claim 1 wherein the first coupling mechanism excludes any loop, overhand or spiral stitching.

10. The bag of claim 1 wherein the first and second panels are both generally flat and planar, at locations extending away from but immediately adjacent to the reinforcing member, for a distance at least equal to a width of the reinforcing member in a direction perpendicular to the outer edges.

11. The bag of claim 1 wherein the reinforcing member is only single ply and is not folded about itself at or adjacent to each outer edge.

12. The bag of claim 1 wherein the reinforcing member entirely covers the outer edge of the first panel, the outer edge of the second panel, and the first coupling mechanism.

13. The bag of claim 1 wherein at least one of the first and second panels is generally flat and planar, and parallel to the reinforcing member, at locations extending away from but immediately adjacent to the reinforcing member, for a distance at least equal to a width of the reinforcing member in a direction perpendicular to the associated outer edge.

14. The bag of claim 1 wherein the reinforcing member is generally "U" shaped in end view and has a pair of parallel spaced apart legs, and is wrapped around the outer edge of the first panel, the outer edge of the second panel and the first coupling mechanism, and wherein the second coupling member extends through both legs of the reinforcing member.

15. A bag comprising:

a first panel having an outer edge;

a second panel having an outer edge and coupled to the first panel by a first coupling mechanism; and a reinforcing member extending along and at least partially covering at least one of the outer edge of the first panel, the outer edge of the second panel, or the first coupling mechanism, wherein the reinforcing member is coupled to at least one of the first panel, the second panel or the first coupling mechanism by a second coupling mechanism, wherein at least one of the first and second panels is generally flat and planar, and parallel to the reinforcing member, at locations extending away from but immediately adjacent to the reinforcing member, for a distance at least equal to a width of the reinforcing member in a direction perpendicular to the associated outer edge.

16. The bag of claim 15 wherein both of the first and second panels are generally flat and planar, and parallel to the reinforcing member, at locations extending away from but immediately adjacent to the reinforcing member, for a distance at least equal to a width of the reinforcing member in a direction perpendicular to the associated outer edge.

17. The bag of claim 15 wherein the reinforcing member is generally "U" shaped in end view and has a pair of parallel spaced apart legs, and is wrapped around the outer edge of the first panel, the outer edge of the second panel and the first coupling mechanism, and wherein the second coupling member extends through both legs of the reinforcing member.

18. The bag of claim 15 wherein the first coupling mechanism is stitching that extends through the first and second panels but through not the reinforcing member, and wherein the second coupling member is stitching that extends through the first and second panels and the reinforcing member.

19. The bag of claim 15 wherein the reinforcing member is only single ply and is not folded about itself at or adjacent to each outer edge, and wherein the bag lacks any other panels positioned within the reinforcing member other than the first and second panels.

* * * * *